US008201635B2

(12) United States Patent
Lohbeck

(10) Patent No.: US 8,201,635 B2
(45) Date of Patent: Jun. 19, 2012

(54) APPARATUS AND METHODS FOR EXPANDING TUBULAR ELEMENTS

(75) Inventor: Wilhelmus Christianus Maria Lohbeck, Rijswijk (NL)

(73) Assignee: Enventure Global Technlogy, LLC, Houston, TX (US)

( * ) Notice: Subject to any disclaimer, the term of this patent is extended or adjusted under 35 U.S.C. 154(b) by 321 days.

(21) Appl. No.: 12/612,577

(22) Filed: Nov. 4, 2009

(65) Prior Publication Data

US 2010/0193199 A1 Aug. 5, 2010

Related U.S. Application Data

(63) Continuation of application No. PCT/EP2008/055443, filed on May 2, 2008.

(51) Int. Cl.
*E21B 43/10* (2006.01)

(52) U.S. Cl. ..... 166/380; 166/207

(58) Field of Classification Search ..... 166/207, 166/217, 380
See application file for complete search history.

(56) References Cited

U.S. PATENT DOCUMENTS

| | | | | |
|---|---|---|---|---|
| 4,388,752 | A | 6/1983 | Vinciguerra et al. | |
| 4,893,623 | A * | 1/1990 | Rosenbluth | 606/192 |
| 7,360,591 | B2 | 4/2008 | Ring | |
| 2003/0121558 | A1 | 7/2003 | Cook et al. | |
| 2003/0192703 | A1 | 10/2003 | Williams et al. | |
| 2005/0217865 | A1 | 10/2005 | Ring | |
| 2006/0162938 | A1 * | 7/2006 | Lohbeck et al. | 166/380 |
| 2010/0314130 | A1 * | 12/2010 | Durst et al. | 166/382 |
| 2011/0120700 | A1 * | 5/2011 | Noel | 166/207 |

FOREIGN PATENT DOCUMENTS

| | | |
|---|---|---|
| GB | 0 393 467 | 6/1933 |
| GB | 2 406 125 | 3/2005 |
| GB | 2 401 132 | 8/2006 |
| GB | 2 426 993 | 12/2006 |
| GB | 2 399 839 | 7/2007 |
| WO | WO 2005/005772 | 1/2005 |
| WO | WO 2008/031832 | 3/2008 |
| WO | WO 2008/135538 | 11/2008 |

OTHER PUBLICATIONS

International Search Report and Written Opinion for PCT/EP2008/055442, 17 pages.
International Search Report and Written Opinion for PCT/EP2008/055443, 15 pages.
European application No. 08750011.2 communication pursuant to Article 94(3) dated May 6, 2010, 3 pages.

* cited by examiner

*Primary Examiner* — David Andrews
(74) *Attorney, Agent, or Firm* — Edmonds & Nolte, PC; Derek V. Forinash

(57) ABSTRACT

A tubular element can be expanded using an expander tool that includes a flexible sleeve having an outer diameter less than or equal to the inner diameter of the tubular element, a cone expander section on which the sleeve is mounted and an elongate mandrel. The cone expander section includes a first cone having a first narrow end that fits inside the sleeve and that increases in diameter from the first narrow end to a maximum at a base that is greater than the inner diameter of the sleeve but less than the inner diameter of the tubular element. The expander tool can be positioned at a predetermined location in the tubular element, fixed in place, and the expander section can be urged through the sleeve to expand the sleeve and thus the tubular element.

11 Claims, 6 Drawing Sheets

APPARATUS AND METHODS FOR EXPANDING TUBULAR ELEMENTS

CROSS-REFERENCE TO RELATED APPLICATIONS

This application is a continuation of PCT application PCT/EP2008/055443 filed May 2, 2008, which claims priority to GB 0708624.2 filed May 4, 2007. Both applications are incorporated herein by reference in their entirety.

TECHNICAL FIELD

The invention relates to apparatus and methods for expanding tubular elements that are suitable for installation in a well such as an oil or gas well, or tubulars of surface, subsea or subsurface pipelines. The invention also relates to systems that employ apparatus and methods for expanding tubular elements.

BACKGROUND ART

Tubular elements such as casing and completion tubing, screens and other such devices are well known in the field of oil and gas wells. In order for tubular elements to be installed in the well, it is necessary that the tubular elements have an outer diameter that is less than the inner diameter of the borehole in which they are to be installed. In fact, since the inner diameter of the borehole can vary and the trajectory of the borehole is often not straight, the maximum possible diameter can be significantly less than that of the borehole at any point.

When a borehole is being drilled, it is usually necessary to stop drilling after a certain depth and stabilize the borehole by placing a steel tubular casing in the well and filling the annulus between the outside of the casing and the borehole wall with cement. This operation may need to be repeated several times during the drilling of the well, each successive casing being necessarily smaller than the inside diameter of the preceding casing. This in turn leads to progressive reduction of the inner open diameter of the well which in turn places limitations on the maximum depth of the well and on the quantities of fluids that can flow along the well.

To overcome this problem, it has been previously proposed to expand the casing in the well to reduce the annular space. Also, expansion of subsequent casings to match the diameter of the previous casing has also been proposed to avoid the progressive diameter reduction found with conventional casing techniques.

Expansion is typically achieved using a cone shaped expanding tool having a maximum diameter that is greater than the inside diameter of the casing to be expanded. Forcing the expanding tool through the casing (for example by mechanically pushing or pulling or by pumping a fluid) causes the casing to expand. One difficulty in this operation is that because the outer diameter of the expansion tool is greater than the inner diameter of the casing, it is not possible to position the expanding tool in the casing; it must either start at the top or bottom and be moved either to the other end or back to its starting place to be removed from the casing (or left in the well). To address this, expanding tools/cones have been proposed that are initially positioned in a contracted state and then are reconfigured into their (larger) operational configuration before being moved through the casing. However, since the outer diameter is still greater than the inner diameter of the casing, this must be done in an open section of the well or in a section of wider diameter. A recent alternative proposal is for the tool to apply enough force during deployment to expand the casing.

SUMMARY

In some embodiments, expansion can be initiated in a section of the casing or other tubular in its unexpanded state and so can create either a complete expansion, or a chamber/expanded section in which a conventional expanding tool cal be deployed. This can be done using a flexible sleeve and an expanding tool that can fit in the unexpanded tubular element. In some embodiments, the expansion apparatus may reduce the need for the use of cementing in wells.

In an embodiment, a tubular element may be expanded by installing an expander tool in the tubular element, the expander tool including a flexible sleeve made from a flexible material of predetermined thickness, the flexible sleeve having an outer diameter that is less than or equal to an inner diameter of the tubular element. The expander tool also includes a cone expander section on which the sleeve is mounted, the cone expander section including a first cone with a first narrow end that fits inside the sleeve and which increases in diameter from the first narrow end to a maximum at a base that is greater than the inner diameter of the sleeve but less than the inner diameter of the tubular element. The expander tool also includes a first elongate mandrel that extends from the end of the cone expander section on the opposite side to the first narrow end.

The expander tool including the sleeve is positioned at a predetermined location in the tubular element to be expanded, and the position of the sleeve is fixed at the predetermined location. The expander section is urged through the sleeve from one end to the other so as to expand the sleeve against the inside of the tubular member and, in turn, cause the tubular member to expand. The expander is urged through the sleeve until the expander exits the other end of the sleeve, which in some embodiments may be lubricated. The sleeve is allowed to contract around the first mandrel such that the outer diameter of the sleeve is less than the un-expanded inner diameter of the tubular element. The expander tool is moved away from the expanded location with the sleeve located around the first mandrel.

In an embodiment, an apparatus for expanding a tubular element in a well includes a flexible sleeve having an outer diameter that is less than or equal to an inner diameter of the tubular element, and is made from a flexible material having a predetermined thickness. The apparatus includes a cone expander section on which the sleeve is mounted. The cone expander section has a first cone that has a first narrow end that fits inside the sleeve and a diameter that increases from the first narrow end to a maximum at a base that is greater than the inner diameter of the sleeve but less than the inner diameter of the tubular element. A first elongate mandrel extends from an end of the cone expander section on a side opposite to the first narrow end.

In some embodiments, the apparatus allows expansion of the tubular element starting from its normal diameter without the need to provide a local expansion or oversized portion to allow deployment of an expansion tool.

In an embodiment, the step of fixing the position of the sleeve at the predetermined location in the tubular element includes activating an anchoring mechanism on the expander tool. In another embodiment, the step of fixing the position of the sleeve includes a compressible ring, such as a ring made from polyurethane, mounted on the expander tool (for example, at its nose-end), and activation of the anchoring mechanism includes compressing the ring axially so as to cause its outer diameter to increase and locally expand the sleeve against the tubular member to anchor it. In some embodiments, expansion of the ring also causes local expansion of the tubular element, in which case a shifting element may be required to allow the cone to move while the sleeve remains stationary.

In an embodiment, the step of fixing the position of the sleeve at the predetermined location in the tubular element includes forcing the sleeve against a locating formation on the inside of the tubular member.

In an embodiment, the expander tool includes a second cone at the other end of the expander section, the middle of the expander section defining the base of the first and second cones, the first mandrel extending from the narrow end of the second cone and the second elongate mandrel extending from the narrow end of the first cone.

A method of expanding a tubular element includes positioning the expander tool at a first predetermined location in the tubular element to be expanded. The position of the sleeve is fixed at the first predetermined location. The expander section is urged through the sleeve from one end to the other so as to expand the sleeve against an inside of the tubular member and cause the tubular member to expand, the expander section being urged through the sleeve until the expander section exits the other end of the sleeve. The sleeve is allowed to contract around the first mandrel such that an outer diameter of the sleeve is less than an unexpanded inner diameter of the tubular element.

The position of the sleeve is fixed at a second predetermined location. The expander section is urged back through the sleeve from one end to the other so as to expand the sleeve against the inside of the tubular member and in turn cause the tubular member to expand, the expander being urged through the sleeve until it exits the other end of the sleeve. The sleeve is allowed to contract around the second mandrel such that the outer diameter of the sleeve is less than the unexpended inner diameter of the tubular element, and the expander tool is moved with the sleeve located around the first mandrel away from the expanded location. This allows multiple expansion operations to be performed at different locations throughout the well.

In some embodiments, the sleeve is made from a flexible/elastic material of predetermined thickness that includes elongate reinforcing members running axially though the sleeve. This resists the tendency of the sleeve to lengthen as it is compressed rather than expand outwardly.

An embodiment of includes a method of expanding a tubular element suitable for installation in a well. A flexible sleeve is installed at a predetermined location in the tubular element to be expanded, the sleeve having an outer diameter that is less than or equal to an inner diameter of the tubular element. The sleeve may be made from a flexible material of predetermined thickness and may have elongate reinforcing members running axially through the sleeve. An expander is installed in the tubular element adjacent to the sleeve, the expander having one end closest to the sleeve that is smaller than the inner diameter of the sleeve, the outer diameter of the expander increasing from the one end to a maximum that is greater than the inner diameter of the sleeve but less than the inner diameter of the tubular element. The expander is urged through the sleeve so as to expand the sleeve against the inside of the tubular member and cause it in turn to expand.

In some embodiments, the reinforcing members may include steel rods or aramide fibres twalon/kevlar that run for substantially the whole length of the sleeve. In some embodiments, the reinforcing members are formed in loops. In some embodiments, the sleeve is formed from polyurethane.

In some embodiments, an application of the apparatus described herein may be for a device to produce one or more areas of isolation. The areas may be in the annulus of a well or the areas may be selected areas in a tubular of a well. The method of producing these areas of isolation is attained by the expansion of tubular elements in the areas of interest.

In some embodiments, the apparatus and method described herein provide for a liner hanger including an apparatus for expanding tubular elements as described above.

In some embodiments, the apparatus and method described herein provide for a fishing tool including an apparatus for expanding tubular elements as described above. The fishing tool may further include a conduit. This conduit may allow for circulation through the fishing tool. The conduit may further allow for circulation through the article to be fished.

In some embodiments, the apparatus and method described herein provide for a wellhead including an apparatus for expanding tubular elements as described above. The apparatus may be used to expand more than one concentric tubular element.

In some embodiments, the apparatus and method described herein provide for an abandonment plug including an apparatus for expanding tubular elements as described above. The apparatus may be used to expand a tubular element in a well to be abandoned. This tubular element may be an additional tubular element inside the casing or liner. The expansion body may be left in an expanded state in the expanded tubular element to form the abandonment plug. The additional tubular element may be expanded so as to close the micro-annulus around the casing or liner.

In some embodiments, the apparatus and method described herein provide for an expandable sand screen including an apparatus for expanding tubular elements as described above.

In some embodiments, the apparatus and method described herein provide for a well pressure tester including an apparatus for expanding tubular elements as described above. The apparatus for expanding tubular elements in the well pressure tester may use expansion of a compressible expansion body substantially to form a seal against the tubular element.

In some embodiments, the apparatus and method described herein provide for a pile expander including an apparatus for expanding tubular elements as described above.

In some embodiments, the apparatus and method described herein provide for a bridge plug including an apparatus for expanding tubular elements as described above. The bridge plug may be permanent or it may be retrievable. This tubular element to be expanded may be an additional tubular element inside the casing or liner. The apparatus for expanding tubular elements in the well pressure tester may use expansion of a compressible expansion body substantially to form a seal against the tubular element.

In some embodiments, the apparatus and method described herein provide for a packer including an apparatus for expanding tubular elements as described above. This tubular element to be expanded may be an additional tubular element inside the casing or liner. The apparatus for expanding tubular elements in the well pressure tester may use expansion of a compressible expansion body substantially to form a seal against the tubular element.

In some embodiments, the apparatus and method described herein provide for a pipe connector including an apparatus for expanding tubular elements as described above. In some cases, the pipe connector may be a swage type pipe connector.

In some embodiments, the apparatus and method described herein provide for a selective chemical placement tool including an apparatus for expanding tubular elements as described above. The selective chemical placement tool may be slidably displaceable.

In some embodiments, the apparatus and method described herein provide for an anchor device including an apparatus for expanding tubular elements as described above. The anchor device may be used to anchor a tubular element or other equipment against the formation or another tubular element.

In some embodiments, the apparatus and method described herein provide for a bellow expander including an apparatus for expanding tubular elements as described above. The bellow expander may be used to relieve buckling or axial stresses in the tubular element.

In some embodiments, the apparatus and method described herein provide for a downhole patching system including an apparatus for expanding tubular elements as described above. The downhole patching system may be used to repair casing or liner damage, or leaking connectors. It may further include a sealing element.

In some embodiments, the apparatus and method described herein provide for a perforation shut off patch system including an apparatus for expanding tubular elements as described above. The perforation shut off patch may further include a sealing element.

In some embodiments, the apparatus and method described herein provide for a telescopic liner expansion system including an apparatus for expanding tubular elements as described above.

Other uses will be apparent from the description below.

DETAILED DESCRIPTION

Figure 1:
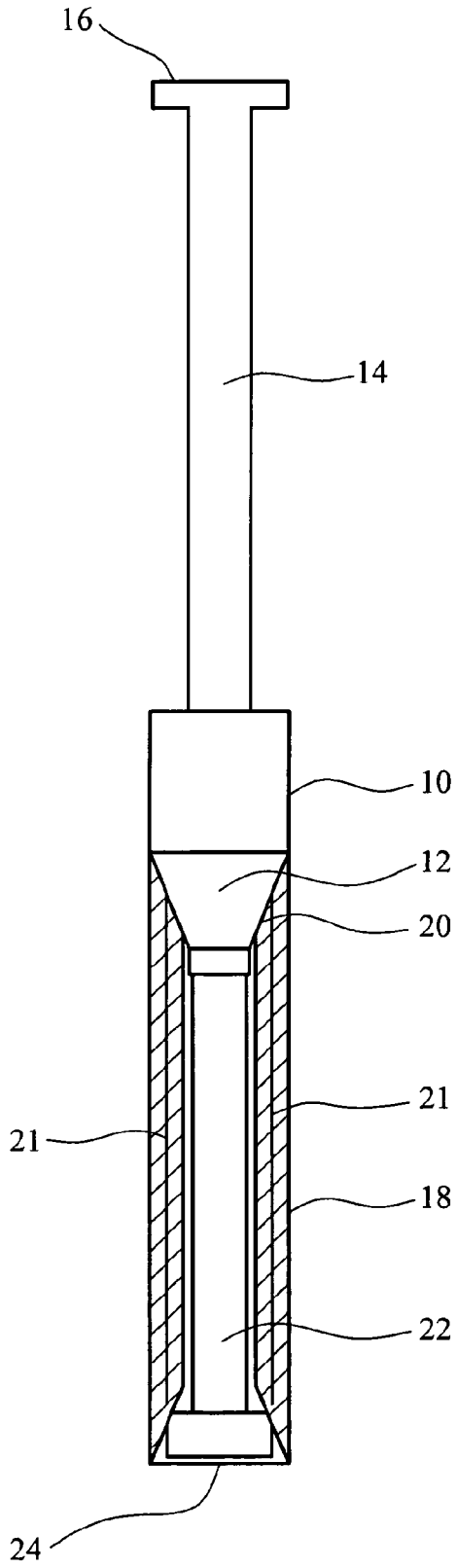
FIG. 1 shows a schematic side view of apparatus for expanding tubular elements according to an embodiment.

FIG. 1 shows a schematic diagram of a tool according to a first embodiment, including a cone expander section 10 having a cone 12 that expands from a narrow end to a base in the middle of the section 10. An elongate mandrel 14 extends from the base part of the section 10 on the opposite side to the cone 12 and optionally has a retainer 16 located at its other end.

A flexible sleeve 18 having internally flared end portions 20 is seated on the cone 12. The internally flared end portions 20 have a complementary angle to the cone 12. In some embodiments, the internally flared end portions 20 are at about 7 degrees. The sleeve is formed from a flexible material and may be formed of polyurethane. Elongate steel reinforcing wires 21 run through the interior of the material making up the sleeve 18. The outer diameter of the sleeve 18 is substantially the same as that of the base of the cone in the expander section. The inner diameter of the sleeve 18 is less than this such that the cone section 10 is not free to move through the sleeve 18.

Figure 2:
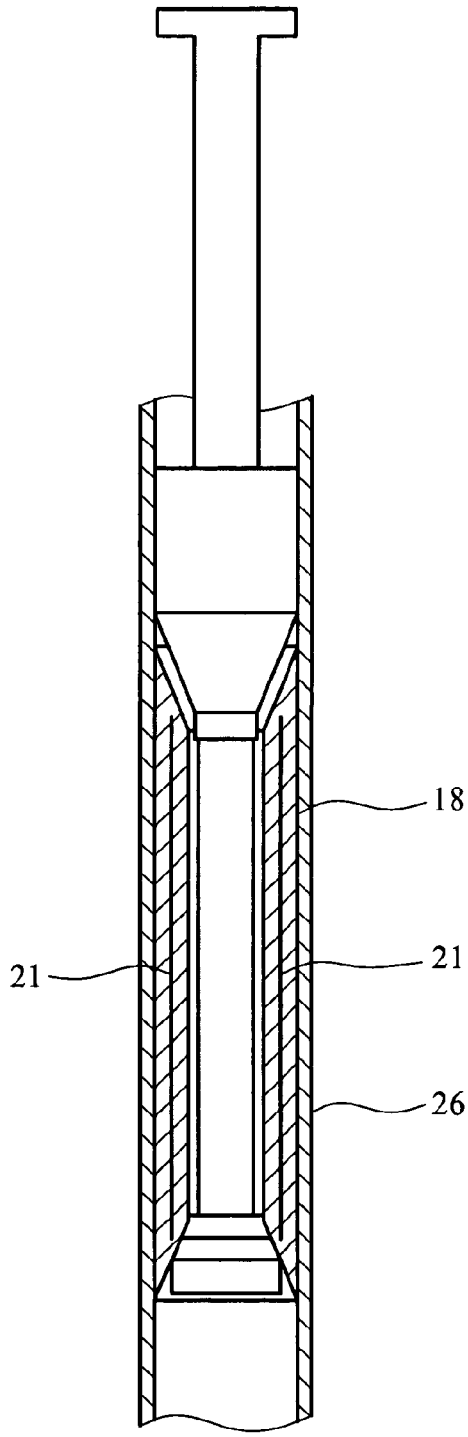
FIG. 2 shows a schematic side view of apparatus for expanding tubular elements of the embodiment of FIG. 1 in situ in a well casing.

A further elongate mandrel 22 extends from the narrow end of the cone 12 through the middle of the sleeve 18 and has a further retainer 24 at its free end. In the embodiment illustrated in FIG. 1, the sleeve is held on the cone 12 projecting into the flared end 20 of the sleeve 18, the retainer 24 preventing accidental disengagement. In this embodiment, the tool can be moved through a casing 26 in a well such as an oil or gas well. The outer diameter of the cone section 10 and sleeve 18 may be marginally smaller than the inner diameter of the casing 26 (see FIG. 2).

In use, the tool described above is lowered to a position of interest (FIG. 2). The sleeve 18 is then anchored in the casing 26 (as is described below) to prevent further downward movement.

Figure 3:
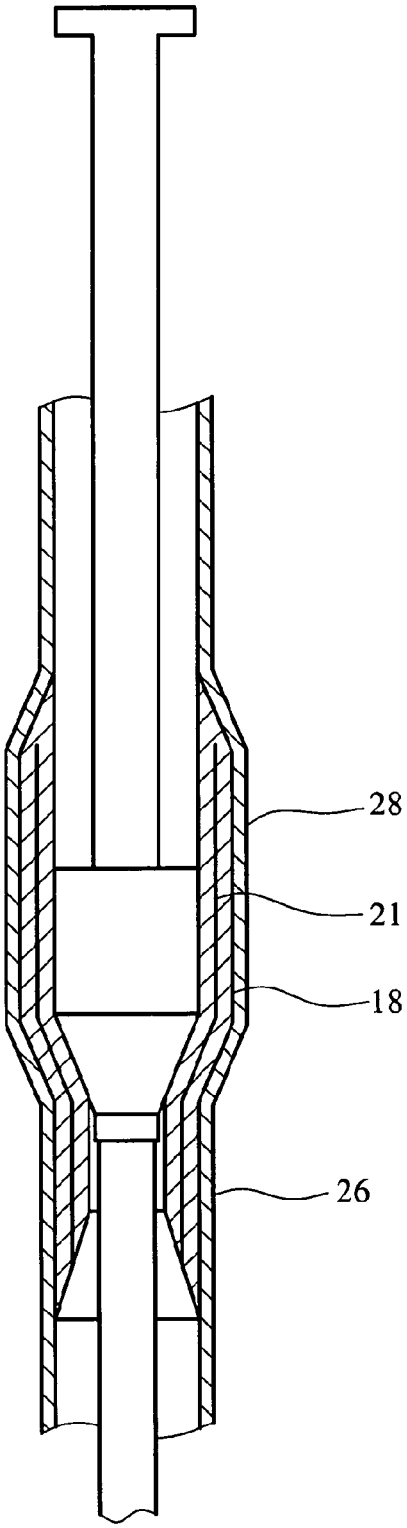
FIG. 3 shows a schematic side view of apparatus for expanding tubular elements the embodiment of FIG. 2 after partial expansion.

Once the tool/sleeve is anchored in position, the cone 12 is forced into the end of the sleeve 18 which is forced to expand until the base can fit inside the sleeve 18. Expansion of the sleeve 18 radially outwardly in turn causes the casing 26 to expand in a corresponding manner and deform permanently 28 (FIG. 3). The reinforcing wires 21 act to restrict lengthening of the sleeve by longitudinal extrusion rather than expanding radially.

Figure 4:
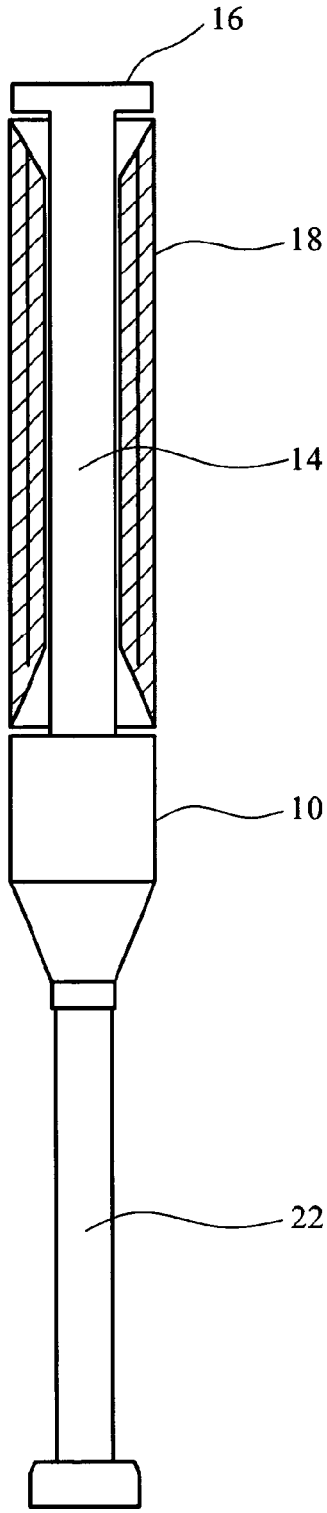
FIG. 4 shows a schematic side view of apparatus for expanding tubular elements of the embodiment of FIG. 1 after expansion has been completed.

The cone 12 is forced down the sleeve 18 until it exits the far end, at which point the sleeve is allowed to relax back to its original dimensions around the mandrel 14, its outer diameter returning to its approximate original value (see FIG. 4). The tool can then be withdrawn from the well with the sleeve 18 on the mandrel 14 leaving only the expanded portion of the casing 28 ready for use.

The tool/cone expander can be pushed/pulled down through the sleeve by any suitable means. For example, it can be pumped down using pressuerized fluid and an appropriate arrangement of seals above the sleeve 18. Alternatively, a mechanical drive can be connected to the top of the tool, extending either from the surface or from an anchored point in the casing above. The tool may be connected to the surface via a cable and/or tubing to provide power and data communication for control, and supply any working fluids that may be needed.

It will be understood that tubular element to be expanded may be any one of a number of tubular elements used in oil or gas wells such as, for example, a casing, a liner, a pipeline, or the like. The tubular element to be expanded may also be one of a number of types of tubulars used in surface, subsea or subsurface pipelines. It will also be understood that the tubular element may be of a solid, slotted or perforated type.

Figure 5:
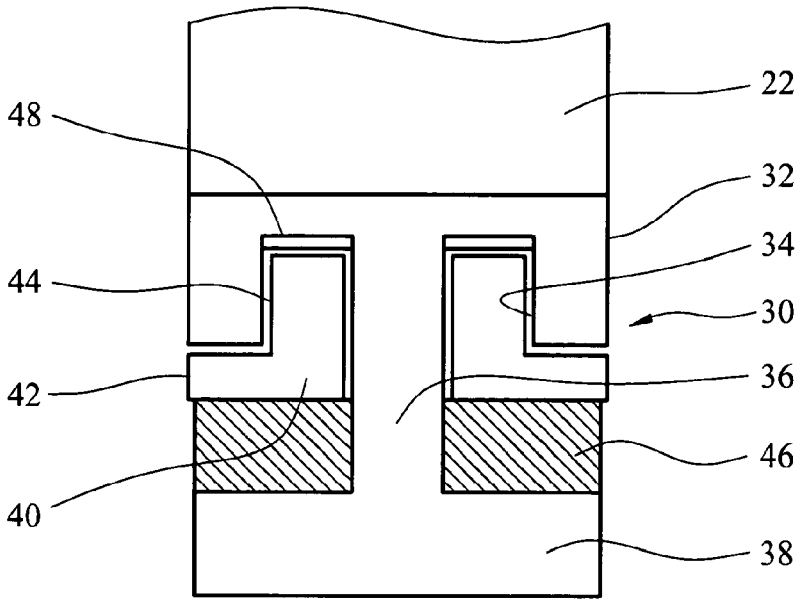
FIG. 5 shows detail of an anchor mechanism.

The anchoring mechanism can include extendible anchors such as slips, dogs, and the like, that can be incorporated into the retainer 24 or provided separately. The anchoring mechanism is operated to act on the sleeve when the tool is in position and lock it to the casing. Thus the tool can be positioned at any point in the casing. Another form of anchor includes an expanding ring as is shown in FIGS. 5 and 6.

In this embodiment, the mandrel 22 is provided with power and control electronics, a pump and hydraulic fluid supply (or a connection to a corresponding supply at the surface) and sensors (not shown). An operational head section 30 is provided at the lower end of the mandrel 22. The head section 30 has a main head part 32 that is is connected to the mandrel 22 and that defines a cylinder 34 open at its lower end. An axial shaft 36 extends from the base of the cylinder 34 and has an end plate 38 connected thereto. A piston 40 is slidably mounted in the cylinder 34 around the shaft 36. The head 42 of the piston 40 has a larger diameter than the part 44 received in the cylinder bore 34, the outer diameter of the head 42 corresponding approximately to the outer diameter of the mandrel 22. A polyurethane ring 46 is mounted around the shaft 36 between the piston head 42 and the end plate 38. This too has an outer diameter corresponding approximately to the outer diameter of the mandrel 22. The working space 48 in the cylinder 34 below the piston 40 is connected to a supply of pressurized fluid (not shown) in the mandrel 22.

When the tool is positioned at the desired position in the casing, pressurized fluid is admitted to the working space 48. This forces the piston 40 out of the cylinder 34 so as to squeeze the ring 46 between the head 42 and end plate 38. This squeezing action causes the ring 46 to bulge around its periphery 50 so as to project beyond the outer diameter of the rest of the mandrel 22. The peripheral bulge 50 of the ring 46 causes the sleeve 18 to be pushed out (against the casing to lock the sleeve in place (as the anchor ring must slide over the inside of the sleeve, low friction is required).

Figure 6:
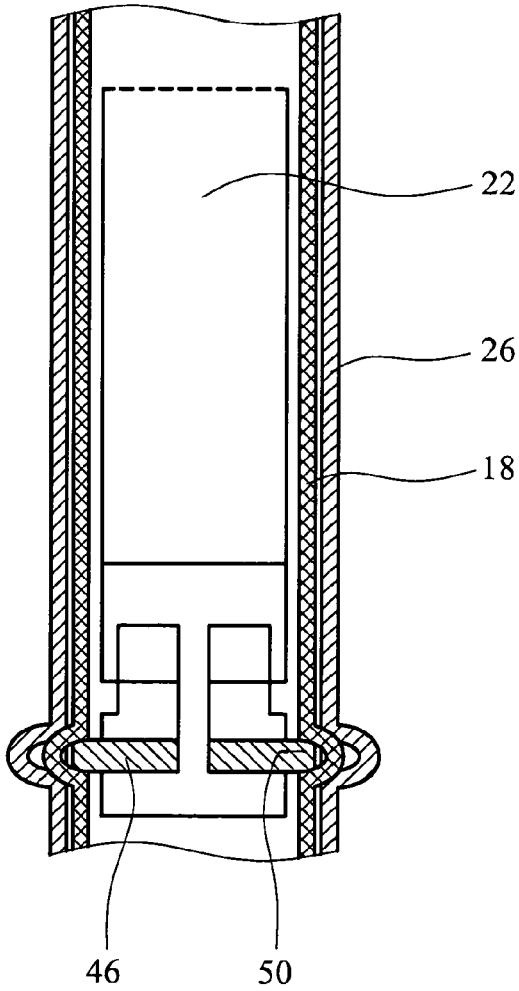
FIG. 6 shows a schematic side view of the anchor mechanism of FIG. 5 deployed in a casing.

The casing 26 in turn is deformed as is shown in FIG. 6. Thus, the sleeve 18 is trapped between the ring bulge 50 and the casing 26 and cannot move as the cone 12 is forced through it. To operate in this manner, it is useful that the cone 12 can slide over the mandrel 22. At the end of the expansion, the cone can be withdrawn and the ring 46 released to allow the sleeve 18 to contract around the mandrel 22 and be moved to another position away from the expanded section of the casing.

It will be noted that in other embodiments, instead of having a ring 46 there may be a thick walled cylinder mounted around the shaft 36 between the piston head 42 and the end plate 38, and this cylinder may serve as an expansion body in tool 10. The material from which the ring 46 or the cylinder is made may be other kinds of flexible and elastic material other than polyurethane such as, for example, rubber. Further, the ring 46 or the cylinder may have more than one section, which may form separate segments. These segments may be housed in compartments specifically shaped therefore in the area around the shaft 36, between the piston head 42 and the end plate 38.

Figure 7:
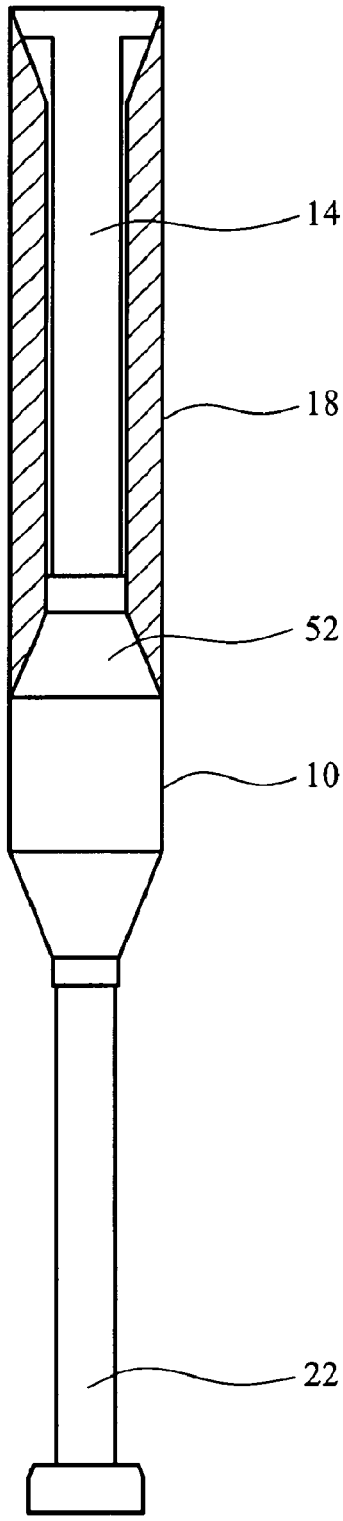
FIG. 7 shows a schematic side view of apparatus for expanding tubular elements according to an embodiment.

In another embodiment, as is shown in FIG. 7, a second cone 52 is provided at on the expander section 10 on the same side as the first mandrel 14. In use, the tool is first used in the manner as described above in relation to FIGS. 1 to 4. The (double sided cone) tool is them moved in the casing to another position, at which the sleeve is again anchored and then expanded by moving the expander section upwards, using the second cone 52 to expand the sleeve 18 in the same manner. At the end of this operation, the sleeve is again located around the mandrel 22 and ready to be moved to another position and operated as before.

Other changes within the scope of the apparatus and methods described herein will be apparent. For example, in one embodiment, anchoring is achieved by providing bumps (not shown) on the inside of the casing 26 against which the free end of the sleeve 18 abuts.

The expansion provided by the apparatus and methods described herein can be used in the manner of previously proposed expansions, for example, to avoid cementing and progressive reduction in the flow diameter of the well, connection of sections of casing, forming of expanded sections for insertion of a succeeding casing section, expansion of a patch over open borehole or existing casing, etc.

There are further various applications of the apparatus described herein which may be used in tubular elements in oil and gas wells, or in tubular elements used in surface, subsea or subsurface pipelines.

Another application of the apparatus described herein is for a downhole anchor device. The anchor device may be used to anchor a tubular element or other equipment against the formation or another tubular element at selected locations in the wellbore.

The apparatus described herein may be applied to expansion of tubular elements against the borehole wall or against another casing. In this way the apparatus can extend to a telescopic liner expansion system which includes the apparatus for expanding tubular elements as described above. Three liners, for example, can be run down a hole at the same time, one inside the other. Each liner can then be extended and the apparatus for expanding tubular elements used to expand each of them.

The apparatus described herein may also be used to form a bell or expanded section, known as a chamber in the art, in which another expansion tool can be deployed for further expansion of the tubular. The bell or expanded section, or chamber, may be used for other purposes as well in drilling or completion operations in oil or gas wells. Expanded section 40 shown in FIG. 5 is an example of such a chamber. The shape of the bell or expanded section, or chamber that is formed may be symmetrical or asymmetrical. Asymmetrical expansion may be accomplished by using a ring 34 which has an asymmetrical shape such as an oval shape. In this case the piston head 30 and the end plate 26 must first be centralized, so that the ring 34 does not move into a position to give symmetrical expansion during use. One of the ways in which asymmetrical expansion is beneficial is when it is used to create a weak point or a specific crack in the casing so that a side passage can be put into the casing at that point.

The bell or expanded section could be used to locate anything that would otherwise cause a restriction downhole. The apparatus would have to be centralized firmly when used in this way. It could thus, for example, be used to house a sub-surface safety valve, pump, separator, etc.

Another application of the apparatus for expansion of tubular elements can be to clad a relatively thin steel tube (with or without seals on the outside) against the inside of a deteriorated old tubing, casing, leaking connector, perforation, etc. Substantially smaller sections or larger sections of tubular can be clad by the apparatus. The cladding may, for example, be used to store carbon dioxide gas in a depleted reservoir, enlarge production tubing or repair leaks.

A further similar application of the apparatus is that it can be used to create a patch or pad downhole for holding sensors that are focused in one direction close to a borehole wall. Similar applications of the apparatus are for a downhole patching system and a perforation shut off patch system. The downhole patching system may be used to repair casing or liner damage, or leaking connectors. The patching system may further include a sealing element, such as an o-ring on the outer diameter (OD).

The apparatus may also be used in the expansion of tubular elements to produce areas of isolation. These areas may be in the annulus of a well or these areas may be at selected zones of a well. These zonal areas of isolation, for example, can be used to squeeze off selective sections for shut off, acid injections, chemical sand consolidation, or the like.

Another application of the apparatus is for a sand screen.

A further application of the apparatus is for a pile expander. The advantage of such a pile expander is that it can improve pile bearing capacity and thus shorter piles may be used.

A further application of the apparatus of the invention is for a liner hanger. The liner hanger may be for use with liners, casing or tubing, as the case may be. In this application the apparatus is preferably used with a sleeve in combination with a sealing element such as an o-ring on the OD.

Figure 8:
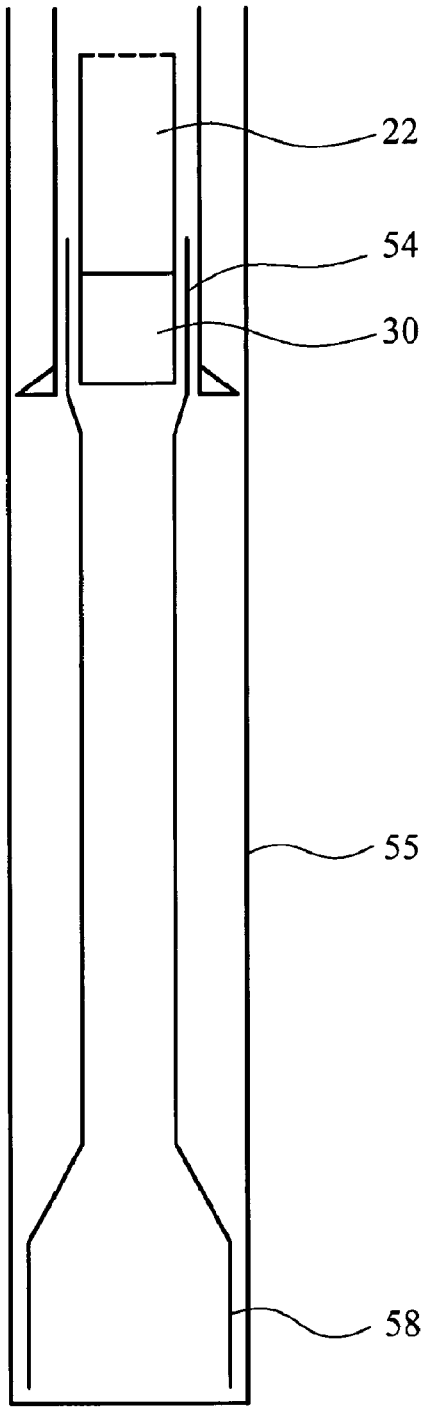
FIG. 8 shows a schematic side view of a liner lap expansion application of an apparatus in situ in a wellbore.

In FIG. 8 a similar application for use in expanding an expandable liner lap 54 is illustrated in a wellbore 55.

Another application of the apparatus described herein is for an expandable fishing tool. The expandable fishing tool may include a conduit through its body. This allows for circulation through the fishing tool. The conduit also allows for circulation through the article to be fished. In this case the article may be the tubular element and the conduit thus allows circulation through the whole of the tubular element including its bottom end in the wellbore. The expandable fishing tool has the advantage of including a larger surface area, which may even create a recess, and thus there is a better grip for the fish, or article to be fished.

Another application of the apparatus is for an expandable wellhead. The apparatus may be used to expand more than one concentric tubular element at the wellhead. In some embodiments, there may be four or five concentric elements at the wellhead that are expanded by the apparatus of the invention. The advantage of this expandable wellhead is that it is then more rigid or robust than conventionally formed wellheads, particularly those used offshore. A further advantage is that a wellhead with a smaller OD can be made.

The apparatus described herein may also be used in an abandonment plug. The tubular element that is expanded in the abandonment plug may be an additional tubular element inside the casing or liner. Such an abandonment plug may include a tube with one open end and one closed end with or without seals around its OD that is expanded against the casing or liner to shut in the well and simultaneously close the micro-annulus. The expansion used against the casing may be minor and is used to close off the micro-annulus. The apparatus may be used to expand the additional tubular element in a well to be abandoned and the expansion body may be left in an expanded state in the expanded tubular element. The abandonment plug may also include a steel sleeve which is also expanded against the casing together with one or more rings 34. The abandonment plug may be used with or without cement and may be deployed by wireline, coiled tubing or other conduit.

Another application of the apparatus described herein is for an expandable sand screen. Similarly the apparatus may also be used in perforated or slotted liner and in casing expansions.

Figure 9:
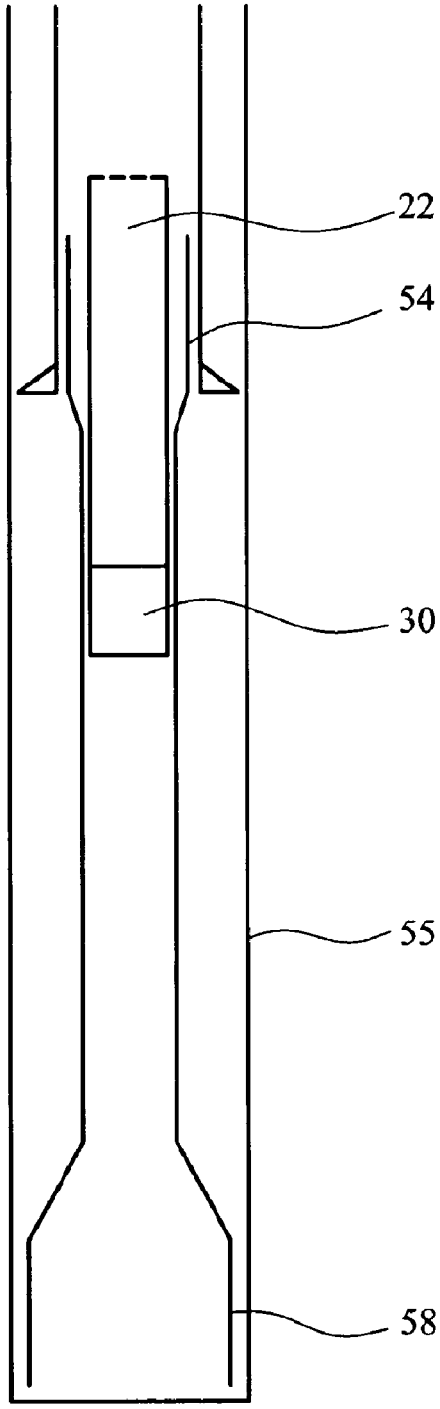
FIG. 9 shows a schematic side view of an application of an apparatus used to pressure test a liner lap and then used to pressure test the liner in situ in a wellbore.
Figure 10:
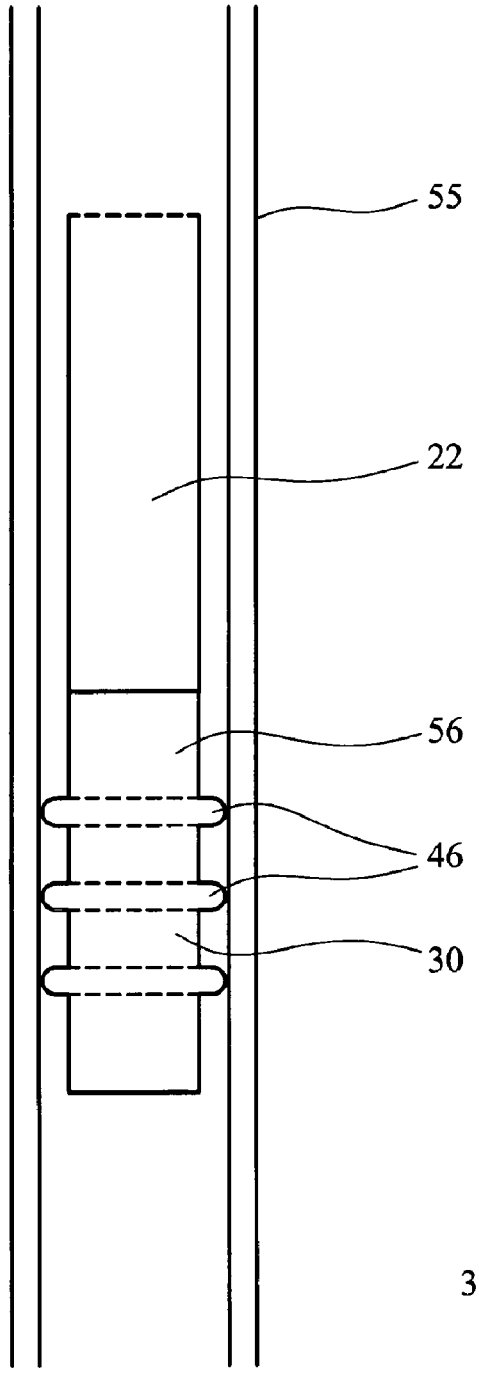
FIG. 10 shows a schematic side view of a pressure tester application of an apparatus in situ in a wellbore.

As shown in FIGS. 9 and 10, a further application of the apparatus described herein is for a well pressure tester. The well pressure tester can be used to pressure test various parts of oil or gas wells such as, for example, a liner lap, the drill pipe, or the formation cementation. In some embodiments, the apparatus for expanding tubular elements in the well pressure tester uses expansion of an expansion body substantially to form a seal against the tubular element and not to expand the tubular element beyond its original shape. The apparatus in this application may include a plurality of rings 46 as shown in FIG. 10. In this example of a pressure tester 56 some of the rings 46 may be used for a packer application to isolate the area of interest and others may be used to expand against the area of interest so as to perform the actual pressure test. A pump or pressure intensifier may also be included downhole with the pressure tester 56 to provide the pressure used in the test. The pressure may also be supplied by an integrated pressure multiplier, or by other means of supplying pressure.

A packer itself is yet another application of the apparatus described herein. The packer may be a permanent installation in the wellbore or may be retrievable and it is used to seal the wellbore either permanently or temporarily. The tubular element to be expanded by the expansion apparatus of the packer may be an additional tubular element inside the casing or liner. In some embodiments, the apparatus for expanding tubular elements in the well pressure tester uses expansion of a compressible expansion body substantially to form a seal against the tubular element and not to expand the tubular element beyond its original shape. The packer may be used in production or for testing, and may be used in cased wellbores or in open wellbores. Typically the packer is used in most completions to isolate the annulus from the production conduit, enabling controlled production, injection or treatment of the wellbore.

The well pressure tester 56 may also be used as a leakoff test device to test the strength or fracture pressure of the open formation. A section of the wellbore can be sealed off using the apparatus and the pressure tester 56 can then be used along with fluid under pressure in the section to test the maximum fluidic pressure which the well can withstand in that particular section. The leakoff test device may also be used at the liner bottom 58.

Figure 11:
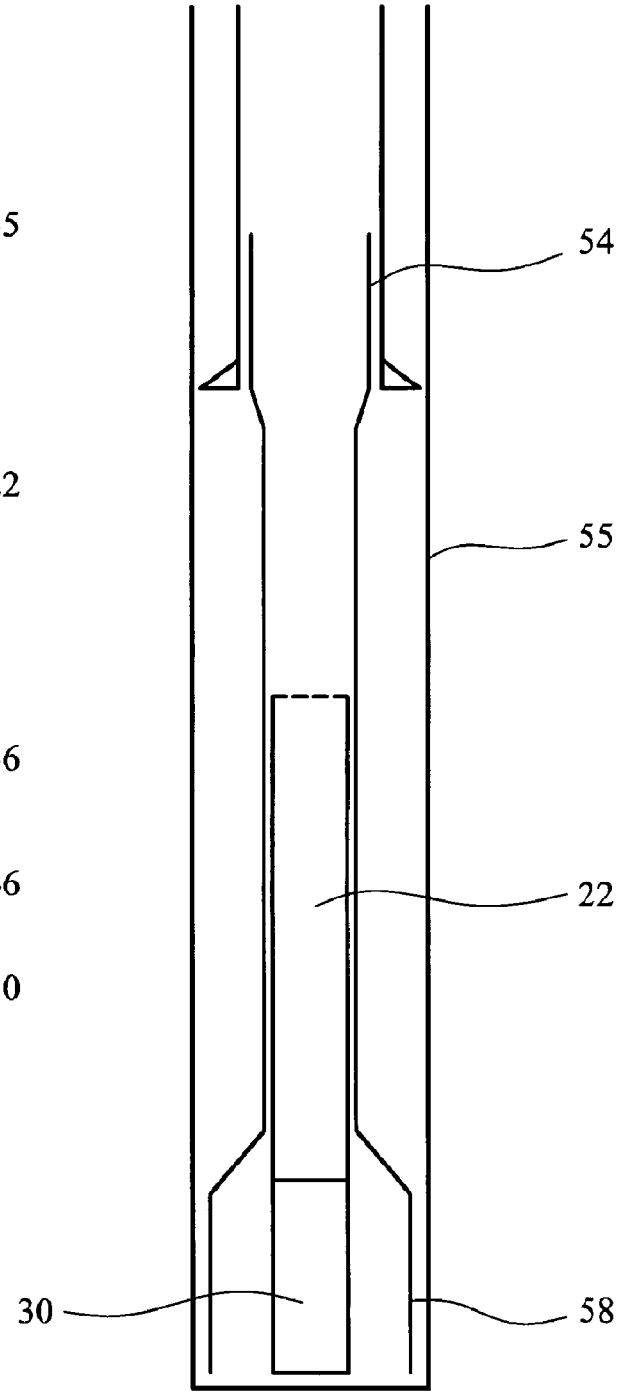
FIG. 11 shows schematic side view of a liner bottom expansion application of an apparatus in situ in a wellbore.

The apparatus described herein may also be used to expand the liner bottom 58 to seal the annulus, as illustrated in FIG. 11.

Another application of the apparatus described herein is for a bridge plug which is used to isolate the lower part of a wellbore. The bridge plug may be permanent, enabling the lower part of the wellbore to be permanently sealed off from production, or it may be retrievable enabling the lower part of the wellbore to be temporarily isolate from the treatment conducted on an upper zone of the wellbore. The tubular element expanded by the bridge plug may be an additional tubular element inside the casing or liner. In some embodiments, the apparatus for expanding tubular elements in the well pressure tester uses expansion of a compressible expansion body substantially to form a seal against the tubular element and not to expand the tubular element beyond its original size. The advantage of the bridge plug is that it may be able to hold more pressure when it is expanded to a level just below the yield of the tubular element. The result is that it will thus will then have more holding force.

The apparatus may also be used in a pipe connector. Typically a pipe, or tubing or casing is expanded to fit substantially tightly against another pipe, tubing or casing, as the case may be, which has been fitted over it and it is then connected using known pipe connection methods. The pipe connector may also be used to connect tubing to casing or to connect a lateral pipe to a central pipe. In some embodiments, the pipe connector is a swage type pipe connector.

Another application of the apparatus described herein is for a selective chemical placement tool. The selective chemical placement tool is typically deployed downhole by coiled tubing, workstring or other conduit. The selective chemical placement tool may be slidably displaceable. In use the selective chemical placement tool is deployed to a particular area of interest and then expansion takes place by the expanding apparatus so that the tool is anchored in the casing or liner across an area to be treated. Chemical fluid is then injected into the body of the tool between its two outer sections and this chemical fluid may then be able to enter areas outside of the casing or liner, that is in the annulus, by squeezing to perform various chemical treatments such as, for example, sand consolidation and chemical shut-off. Once the chemical treatment has been performed, the selective chemical placement tool may then be slidably displaced to another location and then be anchored at that position so that another chemical treatment may be performed at this location. In this way the selective chemical placement tool may be moved sequentially down the wellbore to perform sequential chemical treatments where required.

The apparatus may also be used as part of a bellow expander. The bellow expander may be used to relieve buckling or axial stresses in a tubular element. It may further also be used to convert global buckling of a pipe or casing to localized buckling.

It will be understood that the apparatus and methods of the invention as well as the applications which include them can thus be used in oil and gas wells for holes which are drilled with drill string and which are subsequently lined or cased, as well as in oil or gas wells which are drilled with liners or casings.

The invention claimed is:

1. A method of expanding a tubular element suitable for installation in a well, comprising:

installing an expander tool in the tubular element, the tubular element having an interior and an inner diameter, the expander tool comprising:

a flexible sleeve having an outer diameter less than the inner diameter of the tubular element, and being made from a flexible elastic material of predetermined thickness;

a cone expander section on which the sleeve is mounted, the cone expander section including a first cone having a first narrow end that fits inside the sleeve and having a diameter that increases from the first narrow end to a maximum at a base that is greater than the inner diameter of the sleeve but less than the inner diameter of the tubular element; and a first elongate mandrel extending from an end of the cone expander section on the opposite side to the first narrow end;

positioning the expander tool at a first predetermined location in the tubular element to be expanded;

fixing the position of the flexible sleeve at the first predetermined location;

urging the cone expander section through the flexible sleeve from one end to the other so as to expand the flexible sleeve against the interior of the tubular element and cause the tubular element in turn to expand, the expander tool being urged through the sleeve until it exits the other end of the flexible sleeve;

allowing the flexible sleeve to contract around the first mandrel such that the outer diameter of the sleeve is less than the unexpanded inner diameter of the tubular element; and moving the expander tool with the flexible sleeve located around the first mandrel away from the expanded location.

2. The method as claimed in claim 1, wherein the expander tool further comprises an anchoring mechanism on the expander tool, and the step of fixing the position of the flexible sleeve at the first predetermined location in the tubular element comprises activating the anchoring mechanism.

3. The method as claimed in claim 2, wherein the anchoring mechanism comprises a compressible ring mounted on the expander tool, the compressible ring having an outer diameter, and wherein activating-the anchoring mechanism comprises axially compressing the compressible ring so as to cause its outer diameter to increase and locally expand the flexible sleeve into contact with the tubular member to anchor the flexible sleeve.

4. The method as claimed in claim 3, wherein expanding the compressible ring causes local expansion of the tubular element.

5. The method as claimed in claim 1, wherein the expander tool further comprises:

a second cone at the other end of the expander section, the second cone having a narrow end and a base, the middle of the expander section defining the base of the first and second cones, the first mandrel extending from the narrow end of the second cone and a second elongate mandrel extending from the first narrow end of the first cone;

wherein moving the expander tool away from the expanded location comprises moving the expander tool with the flexible sleeve located around the first mandrel away from the expanded location to a second predetermined location; the method further comprising:

fixing the position of the flexible sleeve at the second predetermined location;

urging the cone expander section back through the flexible sleeve from one end to the other so as to expand the flexible sleeve against the inside of the tubular member and cause it in turn to expand, the expander being urged through the flexible sleeve until it exits the other end of the flexible sleeve;

allowing the flexible sleeve to contract around the second mandrel such that the outer diameter of the flexible sleeve is less than the unexpanded inner diameter of the tubular element; and moving the expander tool with the flexible sleeve located around the first mandrel away from the expanded location.

6. The method as claimed in claim 1, wherein the flexible sleeve is made from a flexible elastic material of predetermined thickness and includes elongate reinforcing members running axially though the flexible sleeve.

7. Apparatus for expanding a tubular element in a well, the tubular element having an inner diameter, the apparatus comprising:

a flexible sleeve having an inner diameter and an outer diameter, the outer diameter being less than the inner diameter of the tubular element, and being made from a flexible elastic material of predetermined thickness;

a cone expander section on which the flexible sleeve is mounted, the cone expander section including a first cone having a first narrow end that fits inside the flexible sleeve and having a diameter that increases from the first narrow end to a maximum at a base that is greater than the inner diameter of the sleeve but less than the inner diameter of the tubular element;

a first elongate mandrel extending from the base of the cone expander section on the opposite side to the first narrow end; and an anchoring mechanism operable to anchor the flexible sleeve in the tubular element to be expanded, wherein the anchoring mechanism comprises an axially compressible ring having an outer diameter, wherein compressing the ring causes its outer diameter to increase and locally expand the flexible sleeve into contact with the tubular member to anchor it.

8. Apparatus as claimed in claim 7, wherein the compressible ring is made from polyurethane.

9. Apparatus as claimed in claim 7, wherein the cone expander further includes a second cone having a narrow end and a base, wherein the base of the second cone is adjacent to the base of the first cone, wherein the first elongate mandrel extends from the narrow end of the second cone and a second elongate mandrel extends from the first narrow end of the first cone.

10. Apparatus as claimed in claim 7, wherein the flexible sleeve is made from polyurethane.

11. Apparatus as claimed in claim 7, wherein the flexible sleeve is flared at one or both ends to aid engagement and movement of the cone.

* * * * *